US007701807B2

(12) United States Patent
Kitazawa et al.

(10) Patent No.: US 7,701,807 B2
(45) Date of Patent: Apr. 20, 2010

(54) ANALOG ELECTRONIC TIMEPIECE THAT PREVENTS DEVIATION OF DISPLAYED TIME WHEN AN IMPACT IS APPLIED TO THE TIMEPIECE

(75) Inventors: Isao Kitazawa, Tokyo (JP); Akiyoshi Murakami, Ageo (JP); Haruhiko Higuchi, Tokorozawa (JP)

(73) Assignee: Citizen Holdings Co., Ltd., Tokyo (JP)

( * ) Notice: Subject to any disclaimer, the term of this patent is extended or adjusted under 35 U.S.C. 154(b) by 0 days.

(21) Appl. No.: 10/582,489

(22) PCT Filed: Nov. 29, 2004

(86) PCT No.: PCT/JP2004/017736

§ 371 (c)(1),
(2), (4) Date: Jun. 12, 2006

(87) PCT Pub. No.: WO2005/057298

PCT Pub. Date: Jun. 23, 2005

(65) Prior Publication Data

US 2007/0115760 A1 May 24, 2007

(30) Foreign Application Priority Data

Dec. 12, 2003 (JP) ..... 2003-414895

(51) Int. Cl.
*G04B 19/04* (2006.01)

(52) U.S. Cl. ..... 368/80; 368/157

(58) Field of Classification Search ..... 368/157, 368/76, 80–81

See application file for complete search history.

(56) References Cited

U.S. PATENT DOCUMENTS

| | | | | |
|---|---|---|---|---|
| 4,404,510 | A | 9/1983 | Nakajima | |
| 4,688,948 | A * | 8/1987 | Kiyono | 368/157 |
| 4,754,210 | A | 6/1988 | Tagezout | |
| 6,194,862 | B1 * | 2/2001 | Hara | 318/696 |
| 6,339,306 | B1 * | 1/2002 | Hara | 318/696 |

FOREIGN PATENT DOCUMENTS

| | | | |
|---|---|---|---|
| JP | 56-110073 | A | 9/1981 |
| JP | 61-061356 | B2 | 1/1982 |
| JP | 57-160081 | A | 10/1982 |
| JP | 58-77487 | U | 5/1983 |
| JP | 60-259982 | A | 12/1985 |
| JP | 2001-91360 | A | 4/2001 |

* cited by examiner

*Primary Examiner*—Vit W Miska
*Assistant Examiner*—Sean Kayes
(74) *Attorney, Agent, or Firm*—Foley & Lardner LLP

(57) ABSTRACT

Impact detecting resistors (141), (143) of an impact detecting circuit (104) detect a counter electromotive force of a step motor (105) generated due to an impact. This counter electromotive force is amplified applying a predetermined period and a predetermined chopper-width by a chopper-amplifying waveform shaping circuit (118). Therefore, even a light impact can be detected. Inverters (145), (146) compare these impact detecting signals (S22), (S23) with a threshold value and detect an impact when the signals exceeds the threshold value. A controlling circuit (102) provides a lock pulse to the step motor (105) through signal lines (AA), (BB) when an impact is detected, brakes rotation of a rotor (162) thereby preventing a deviation of the time displayed with a second hand (106).

20 Claims, 12 Drawing Sheets

FIG.11

| PERIOD | CHOPPER-WIDTH | DETERMI-NATION | REMARK |
|---|---|---|---|
| 2 ms | 61 μS | × | WAVE-SHAPED BOOM GENERATED WHEN LIGHT IMPACT IS APPLIED LASTS APPROXIMATELY 2 MS AND DETECTION IS TOO LATE. |
| 2 ms | 30.5 μS | × | WAVE-SHAPED BOOM GENERATED WHEN LIGHT IMPACT IS APPLIED LASTS APPROXIMATELY 2 MS AND DETECTION IS TOO LATE. |
| 1 ms | 61 μS | × | TIME FROM RECEPTION TO DETECTION OF IMPACT (LIGHT IMPACT) IS AS SHORT AS 36 μS AND DETECTION IS IMPOSSIBLE WHEN IMPACT IS RECEIVED WITHIN CHOPPER. |
| 1 ms | 30.5 μS | O | BOTH OF DETECTION SENSITIVITY AND POWER CONSUMPTION ARE EXCELLENT |
| 0.5 ms | 61 μS | × | DETECTION SENSITIVITY IS MOST EXCELLENT, HOWEVER, POWER CONSUMPTION IS INCREASED BECAUSE CHOPPERS MOVE FAST. |
| 0.5 ms | 30.5 μS | × | DETECTION SENSITIVITY IS EXCELLENT, HOWEVER, POWER CONSUMPTION IS INCREASED BECAUSE CHOPPERS MOVE FAST. |

FIG.12

| | 30 cm | 40 cm | 50 cm | 60 cm |
|---|---|---|---|---|
| 1.8 (V) | OK | OK | OK | OK |
| 1.7 (V) | OK | OK | OK | OK |
| 1.6 (V) | OK | OK | OK | OK |
| 1.5 (V) | TWO-SECOND DELAY | TWO-SECOND DELAY | TWO-SECOND DELAY | TWO-SECOND DELAY |
| 1.4 (V) | TWO-SECOND DELAY | TWO-SECOND DELAY | TWO-SECOND DELAY | TWO-SECOND DELAY |
| 1.35 (V) | OK | TWO-SECOND DELAY | TWO-SECOND DELAY | TWO-SECOND DELAY |
| 1.25 (V) | TWO-SECOND DELAY | TWO-SECOND DELAY | — | — |

IMPACT DETECTING RESISTOR: 5 kΩ, LOCK PULSE SHAPE: LOCK TERM 5 ms, STABLE TERM 5 ms, INSENSITIVE TERM 1 ms
MOTOR DRIVERS: TWO HAND BIASED WEIGHT: 5 mgm

FIG.13

| | 30 cm | 40 cm | 50 cm | 60 cm |
|---|---|---|---|---|
| 1.8 (V) | OK | OK | OK | OK |
| 1.7 (V) | OK | OK | OK | OK |
| 1.6 (V) | OK | OK | OK | OK |
| 1.5 (V) | OK | OK | OK | OK |
| 1.4 (V) | OK | OK | OK | OK |
| 1.35 (V) | OK | OK | OK | OK |
| 1.25 (V) | OK | OK | OK | OK |

IMPACT DETECTING RESISTOR: 5 kΩ, LOCK PULSE SHAPE: LOCK TERM 10 ms, STABLE TERM 5 ms, INSENSITIVE TERM 1 ms
MOTOR DRIVERS: TWO HAND BIASED WEIGHT: 5 mgm

ANALOG ELECTRONIC TIMEPIECE THAT PREVENTS DEVIATION OF DISPLAYED TIME WHEN AN IMPACT IS APPLIED TO THE TIMEPIECE

TECHNICAL FIELD

The present invention relates to an analog electronic timepiece capable of preventing deviation of time displayed thereon even when an impact is applied thereto, and more particularly, to an analog electronic timepiece capable of preventing irregular motions of hands thereof when the timepiece is dropped or an impact is applied to the timepiece.

BACKGROUND ART

Conventionally, an analog electronic timepiece such as a wrist watch, etc., has a structure in which have time hands provided on a display unit rotate. The current time is recognized by the rotational positions of an hour hand, a minute hand, and a second hand that are the hands. Since such a wrist timepiece is small-sized, the visibility of the hands and accuracy of the displayed time are demanded. Especially in a wrist watch, downsizing and low power consumption are demanded. To meet this demand, small thin hands must be used. Therefore, the visibility has been poor.

If, for example, a thick second hand is used to improve the visibility, a weight of the second hand becomes heavy, causing a concern that the displayed time is deviated with only a small impact, that is, degradation of anti-shock property of the timepiece. To improve such an anti-shock property, a retentive power of a step motor that is a driving source should be increased. However, this method can not be employed because the power consumption during driving increases.

Mechanisms to cancel the deviation of the displayed time when an impact is applied externally are disclosed in, for example, Patent Documents 1 and 2 below.

The technique disclosed in Patent Document 1 corrects a deviation of the displayed time by executing rotation control such as outputting a compensation driving signal to a step motor, delaying a normal driving signal until an impact is ceased, etc. when the rotor detects a counter electromotive force generated while being jolted due to an impact. The technique disclosed in Patent Document 2 facilitates detection of an impact by periodically amplifying a counter electromotive force generated when the impact is detected and the level of this counter electromotive force.

Patent Document 1: Japanese Patent Application Laid-Open Publication No. S65-110073

Patent Document 2: Japanese Patent Application Publication No. S61-61356

DISCLOSURE OF INVENTION

Problem to be Solved by the Invention

However, in recent wrist watches, power-generating timepieces have become prevailing. Accordingly, batteries (power sources) have shifted to lower capacity batteries even for wrist watches that respectively include a battery. In addition, down-sizing of wrist watches have been promoted. Therefore, the above conventional techniques may fail to prevent the deviation of the displayed time when an impact is applied to a timepiece.

In view of the above problems, it is an object of the present invention to provide an analog electronic timepiece capable of preventing a deviation of the displayed time thereof even when an impact is applied to the timepiece, while downsizing the timepiece and lowering a capacity of a battery in the timepiece.

Means for Solving Problem

To solve the above problems and to achieve the object, an analog electronic timepiece according to one aspect of the invention includes a driving signal supplying unit configured to generate and supply a reference signal for clocking; an amplifying unit configured to amplify a counter electromotive force generated by a step motor that drives hand motions of time hands; an impact detecting unit configured to detect an impact applied externally based on an output signal level of the amplifying unit; and a controlling unit configured to control to drive the step motor using an intermittent driving pulse based on the reference signal supplied from the driving signal supplying unit when the time hands are in a hand-driven state, and to control to brake the step motor when an impact is detected by the impact detecting unit while the time hands are in a non-hand-driven state. The amplification ratio of the amplifying unit is set to a value that corresponds to at least one of a weight and a moment of inertia of the time hands.

Moreover, in the invention as described above, the analog electronic timepiece according to another aspect of the invention has the amplifying unit that is a chopper-amplifying unit configured to amplify at the amplification ratio based on a predetermined pulse period. The predetermined pulse period is set to a value that corresponds to at least one of the weight and the moment of inertia of the time hand.

Furthermore, in the invention as described above, the analog electronic timepiece according to another aspect of the invention has a chopper-amplifier unit in which the predetermined pulse period is set further to the power source voltage.

Furthermore, in the invention as described above, the analog electronic timepiece according to another aspect of the invention has a chopper-amplifier unit in which a chopper-width is set to 30.5 μs.

Moreover, in the invention as described above, the analog electronic timepiece according to another aspect of the invention has the controlling unit that includes a lock pulse output unit configured to control the step motor when the impact is detected. The lock pulse output unit outputs a lock pulse for a term corresponding to a power source voltage supplied to the step motor.

Furthermore, in the invention as described above, the analog electronic timepiece according to another aspect of the invention has a lock pulse output unit that is configured to output a continuous pulse having a same phase as that of the driving pulse generated when an impact is applied.

Moreover, in the invention as described above, the analog electronic timepiece according to another aspect of the invention has a lock pulse output unit that outputs a lock pulse that includes at least a lock term for outputting a continuous pulse and a stable section for outputting an inversed pulse after the lock terms has passed.

Furthermore, in the invention as described above, the analog electronic timepiece according to another aspect of the invention has the controlling unit that includes a load compensating unit configured to detect rotation of a rotor based on detection of a counter electromotive force from the pulse motor soon after the output of the driving pulse.

Moreover, in the invention as described above, the analog electronic timepiece according to another aspect of the invention has the controlling unit that is configured to provide stable terms respectively for starting the rotor of a pulse motor from a stationary stable point thereof before outputting the driving pulse, and for returning the rotor of the pulse motor to the stationary stable point thereof after outputting the driving pulse.

Furthermore, in the invention as described above, the analog electronic timepiece according to another aspect of the invention has an impact detecting unit constituted of inverters that operate based on supply of a source power that is adapted to supply a constant voltage without depending on a power source voltage.

Moreover, in the invention as described above, the analog electronic timepiece according to another aspect of the invention has the impact detecting unit that includes an impact detecting resistor configured to detect a counter electromotive force from a pulse motor at the time of the impact. The load compensation unit includes a load compensating resistor configured to detect a counter electromotive force from the pulse motor soon after the driving pulse is output.

Furthermore, in the invention as described above, the analog electronic timepiece according to another aspect of the invention has an impact detecting resistor in which a resistance value is set at the minimal resistance value with which the rotation of the pulse motor is detected.

Moreover, in the invention as described above, the analog electronic timepiece according to another aspect of the invention has an impact detecting resistor for which setting is set for each type of timepiece.

Furthermore, in the invention as described above, the analog electronic timepiece according to another aspect of the invention includes a detecting resistor used commonly for the impact detecting resistor and the load compensation resistor. The impact detecting unit and the load compensating unit are configured to detect an impact and load compensation using the detecting resistor.

Moreover, in the invention as described above, the analog electronic timepiece according to another aspect of the invention has a lock pulse output unit that is configured to secure an output term of the lock pulse when a lock pulse is input at a time of a logic frequency adjustment executed at predetermined intervals.

Furthermore, in the invention as described above, the analog electronic timepiece according to another aspect of the invention includes a battery detection controlling unit configured to make the output of the lock pulse precede when the lock pulse is output from the lock pulse output unit at a time of detection of the power source voltage executed at predetermined intervals.

EFFECT OF THE INVENTION

An analog electronic timepiece according to the present invention is capable of preventing a deviation of displayed time even when an impact is applied to the timepiece. Particularly, the timepiece is capable of preventing the deviation of the displayed time by suppressing a motion of hands thereof caused when an impact is applied to the timepiece even if a capacity of a battery is lowered and a main body of the timepiece is down-sized.

BRIEF DESCRIPTION OF DRAWINGS

FIG. 11 is a chart showing an example of settings of a period and a chopper width in the chopper amplification;

FIG. 12 is a chart for explaining a relation between a power source voltage and a time deviation in the configuration according to the present invention;

FIG. 13 is a chart for explaining the relation between the power source voltage and the time deviation in the configuration according to the present invention.

EXPLANATIONS OF LETTERS OR NUMERALS

Figure 1:
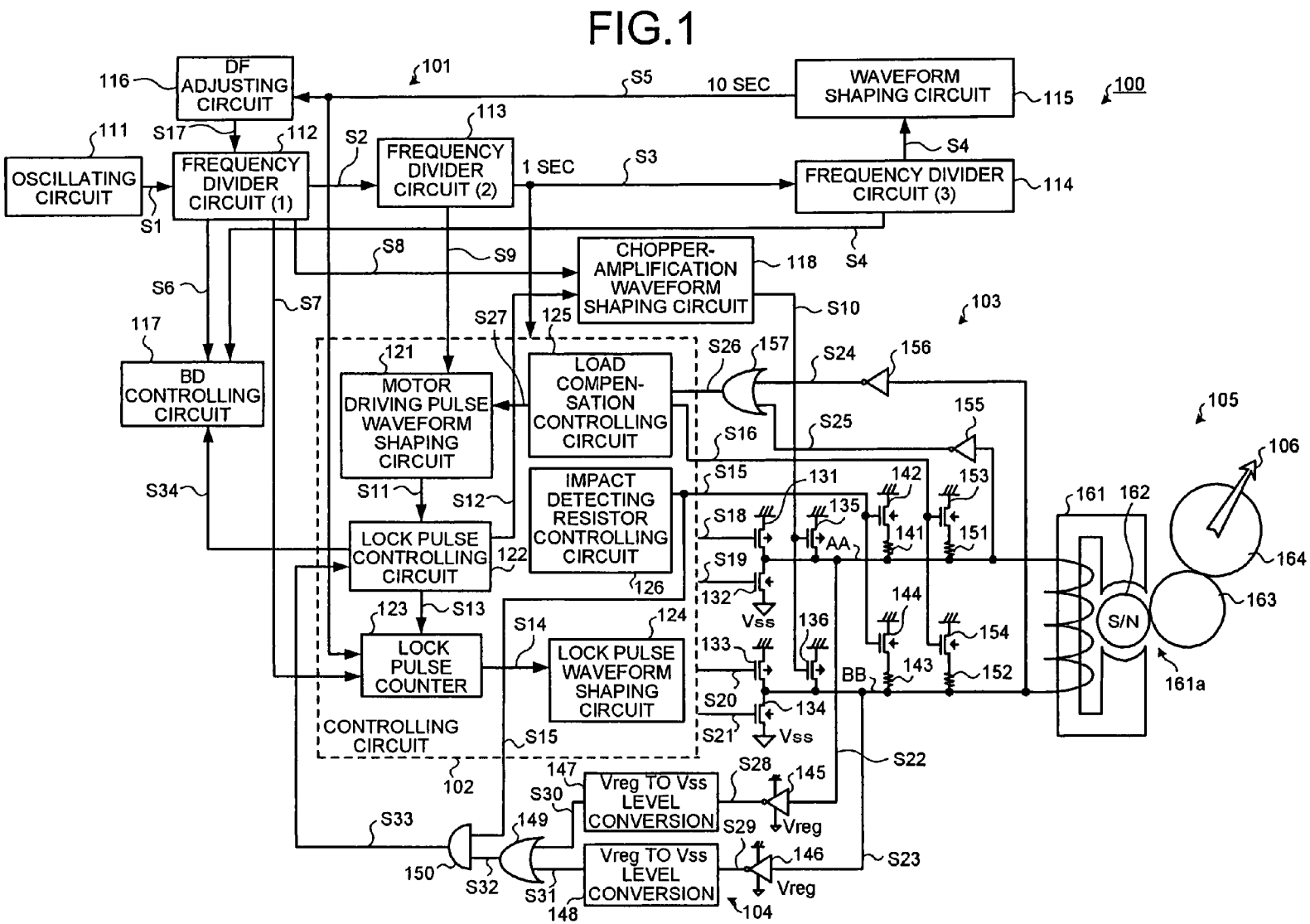
FIG. 1 is a block diagram of a configuration of an analog electric timepiece according to a first embodiment of the present invention.

100 analog electronic timepiece
101 driving signal supplying unit
102 controlling circuit
103 driving circuit
104 impact detecting circuit
105 step motor
106 second hand
111 oscillating circuit
112, 113, 114 frequency divider circuit
115 waveform shaping circuit
116 DF adjusting circuit
117 BD controlling circuit
118 chopper-amplification waveform shaping circuit
121 motor driving pulse waveform shaping circuit
122 lock pulse controlling circuit
123 lock pulse counter
124 lock pulse waveform shaping circuit
125 load compensation controlling circuit
126 impact detecting resistor controlling circuit
131, 132, 133, 134, 135, 136, 142, 144, 153, 154 transistor
141, 143 impact detecting resistor
145, 146 inverter
147, 148 level converting circuit
149, 157 OR circuit
150 AND circuit
151, 152 load compensation detecting resistor
155, 156 inverter
161 coil
161*a* pole piece
162 rotor
163, 164 gear
AA, BB signal line

BEST MODE(S) FOR CARRYING OUT THE INVENTION

Embodiments of an analog electronic timepiece according to the present invention will be explained in detail below with reference to the accompanying drawings. The embodiments are not intended to limit the present invention.

First Embodiment

FIG. 1 is a block diagram of a configuration of an analog electronic timepiece according to a first embodiment of the present invention. An analog electronic timepiece 100 is constituted of a driving signal supplying unit 101, a controlling circuit 102, a driving circuit 103, an impact detecting circuit 104, and a step motor 105. In the drawings, numerals such as S1, S2, etc. are provided to signals output from each unit.

The driving signal supplying unit 101 supplies a driving signal for driving to rotate the time hands provided to a wrist timepiece as the analog electronic timepiece 100. The step motor 105 drives stepwise a second hand 106 at a period of one second. The states where the second hand 106 is being driven and is not being driven are respectively referred to as "hand-driven state" and "non-hand-driven state". The driving signal supplying unit 101 has an oscillating circuit 111 that outputs a reference oscillating signal S1 (32,768 Hz); frequency divider circuits connected in a multi-stage configuration 112, 113, 114 to obtain necessary frequency-dividing outputs S2, S3, S4 based on inputting of the oscillating signal S1 from the oscillating circuit 111; and a waveform shaping circuit 115 that shapes the waveform of the frequency-dividing output S4 (pulses of ten seconds each) of the frequency divider circuit 114.

The driving signal supplying unit 101 also has a DF adjusting circuit 116 that outputs a signal S17 that adjusts logic frequency (DF-adjustment) at a period according to an output S5 of the waveform shaping circuit 115; a BD controlling circuit 117 that executes control when detection of an impact is overlapped on detection of a power source voltage of a driving battery, based on the frequency-dividing outputs S2, S4 respectively of the frequency divider circuits 112, 114; and a chopper amplification waveform shaping circuit 118 that generates a pulse signal chopper-amplified to detect precisely a detection signal of an impact generated during the non-hand-driven state of the second hand 106 based on inputting of a frequency-dividing output S8 of the frequency divider circuit 112 and a controlling signal S12 of a lock pulse output from a lock pulse controlling circuit 122.

The controlling circuit 102 is constituted of, for example, a random logic, and has a motor driving pulse waveform shaping circuit 121 that outputs a controlling signal S11 that disables the lock pulse controlling circuit 122 during a normal pulse term during which the frequency-dividing output S3 (pulses of one second each) of the frequency divider circuit 113; the lock pulse controlling circuit 122 that is input with the controlling signal S11 output from the motor driving pulse waveform shaping circuit 121 and an impact detecting signal S33 detected by the impact detecting circuit 104, and that outputs the controlling signals S12, S13 of an output of the lock pulse that prevent the deviation of the second hand of the step motor 105 when an impact has been detected; a lock pulse counter 123 constituted of a counter that sets an output term based on the controlling signal S13 of the lock pulse output from the lock pulse controlling circuit 122 and the frequency-dividing output S5 (pulses of ten seconds each) after shaping the waveform thereof output from the waveform shaping circuit 115; a lock pulse waveform shaping circuit 124 that shapes the waveform of a lock pulse S14 output from the lock pulse counter 123; a load compensation controlling circuit 125 that detects whether a rotor 162 of the step motor 105 has rotated during a term immediately after a driving pulse has been supplied to the step motor 105 in the hand-driven state of the second hand 106; and impact detecting resistor controlling circuit 126 that stops the detection of impacts in the hand-driven state of the second hand 106 and detects impacts in the non-hand-driven state thereon.

The driving circuit 103 has signal lines AA, BB that supplies driving pulses S18, S19 for driving the second hand 106 every one second from the controlling circuit 102 to the step motor 105. The signal line AA is provided with transistors 131, 132 such as MOS-FET, etc. The signal line BB is provided with transistors 133, 134 that receive driving pulses S20, S21 and supply those pulses S20, S21 to a coil 161 of the step motor 105. The signal line AA is provided with a transistor 135 in parallel to the transistors 131, 132. The signal line BB is provided with a transistor 136 in parallel to the transistors 133, 134. These transistors 135, 136 supply to the signal lines AA, BB a pulse signal S10 for detecting an impact supplied by the chopper-amplification waveform shaping circuit 118 in the non-hand-driven state. These transistors 135, 136 are provided in parallel to the transistors 131, 132, 133, 134 as drivers outputting the driving pulses S18, S19, S20, S21 and, because these transistors 135, 136 are rather small transistors, an increase of power consumption can be suppressed for the gate capacities thereof are small.

The impact detecting circuit 104 has an impact detecting resistor 141 and a transistor 142 both connected with the signal line AA and an impact detecting resistor 143 and a transistor 144 both connected with the signal line BB. The value of resistance of the impact detecting resistor 141 is set at the minimum value (for example, in a range of 40 kΩ to 160 kΩ) for which the fact that the rotor 162 of the step motor 105 has been rotated due to an impact can be detected. Though the sensitivity can be increased by increasing the value of resistance of the resistor 141, at the same time, even a small impact can be detected. Therefore, an appropriate value needs to be set. The value of resistance of this impact detecting resistor 141 can be set or adjusted at an appropriate value for each type of timepiece (for example, the weight of the second hand 106, the moment of inertia (referred to as "biased weight"), and the size) or each individual timepiece when the timepieces are shipped. Thereby, an output of the lock pulse generated when an impact has been detected unnecessarily can be suppressed.

The transistors 142, 144 are controlled by a controlling signal S15 of the impact detecting resistor controlling circuit 126 such that the transistors 142, 144 can detect an impact in the non-hand-driven state. An impact received in the non-hand-driven state of the second hand 106 is represented as a current waveform on the signal lines AA, BB due to a counter electromotive force of the step motor 105. At this point, a chopper-amplified current waveform (impact detecting signal) is input into inverters 145, 146 through signals S22, S23 on an impact detecting line. The inverters 145, 146 compare the input impact detecting signals S22, S23 with a pre-determined threshold value, and when the levels of the impact detecting signals S22, S23 exceed the threshold value, outputs signals S28, S29 (also referred to as "impact detecting signal") indicating a impact-detected state.

Level converting circuits 147, 148 outputs to an OR circuit 149 signals S30, S31 obtained by level-converting these impact detecting signals S28, S29. The OR circuit 149 outputs the signals S30, S31 to an AND circuit 150 as an output S32. The AND circuit 150 is input with this signal (impact detecting signal) S32, and the controlling signal S15 of the impact detecting resistor controlling circuit 126; and outputs only the impact detecting signal S33 detected in the non-hand-driven state to the lock pulse controlling circuit 122. The signal lines AA, BB are connected with load compensation detecting resistors 151, 152 and transistors 153, 154, and a load compensation detecting term is controlled by a signal S16 of the load compensation controlling circuit 125. When the load is compensated, outputs S24, S25 of the inverters 155, 156 connected respectively with the signal lines AA, BB are output to the load compensation controlling circuit 125 as an output S26 through an OR circuit 157. Reflecting the result of the output S26, a signal S27 is output to the motor driving pulse waveform shaping circuit 121.

The step motor 105 is constituted of the rotor 162 capable of rotating at a pole piece 161*a* part of the coil 161; and a plurality of gears 163, 164 interlocked with the rotor 162. The second hand 106 is attached to the final-stage gear 164.

Figure 2:
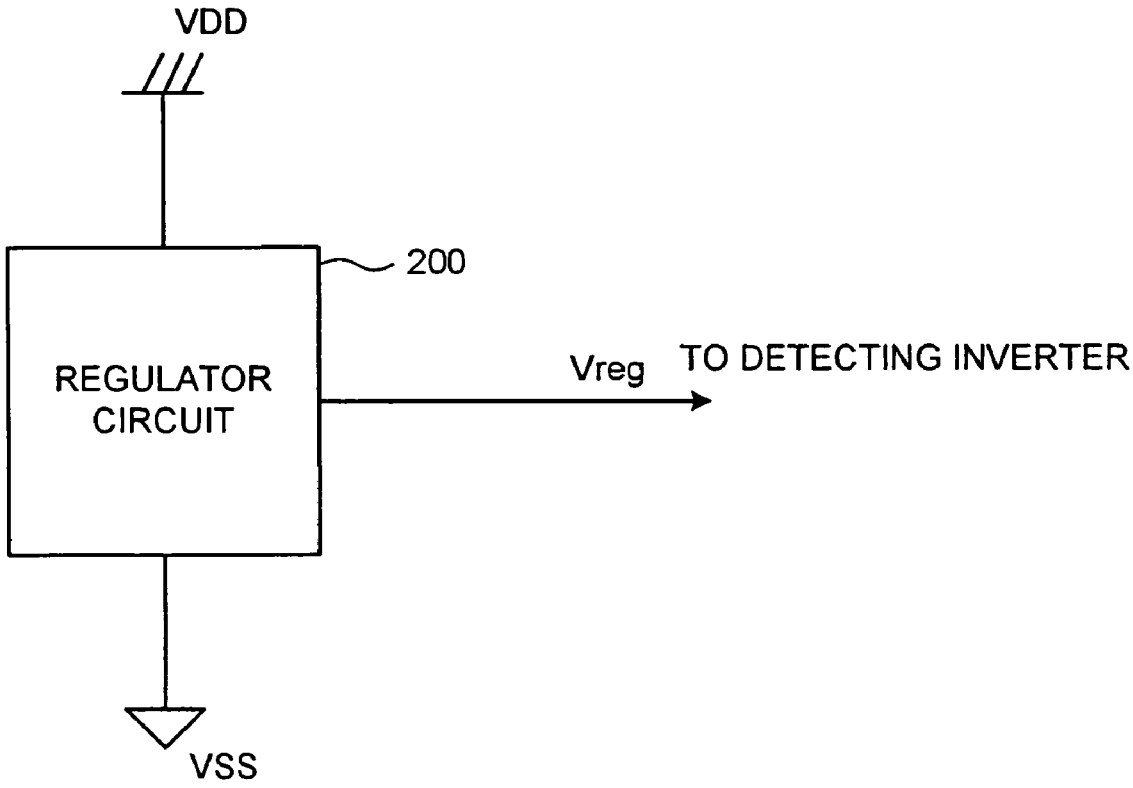
FIG. 2 is a block diagram of a regulator circuit.

FIG. 2 is a block diagram of a regulator circuit. The timepiece of the present invention supplies using a regulator circuit 200 a power source voltage VSS to the inverters 145, 146 of the impact detecting circuit 104 as a constant voltage Vreg. Thus, the inverters 145, 146 can stably detect an impact preventing variation of the sensitivity without depending on the power source voltage. The inverters 145, 146 is set such that, when the level of the impact detecting signal is varied around the threshold value, the inverters 145, 146 lower the ability thereof because the power consumption is increased. Because the detection is executed using the voltage level even with this setting, the detected level and the sensitivity are not influenced.

Figure 3:
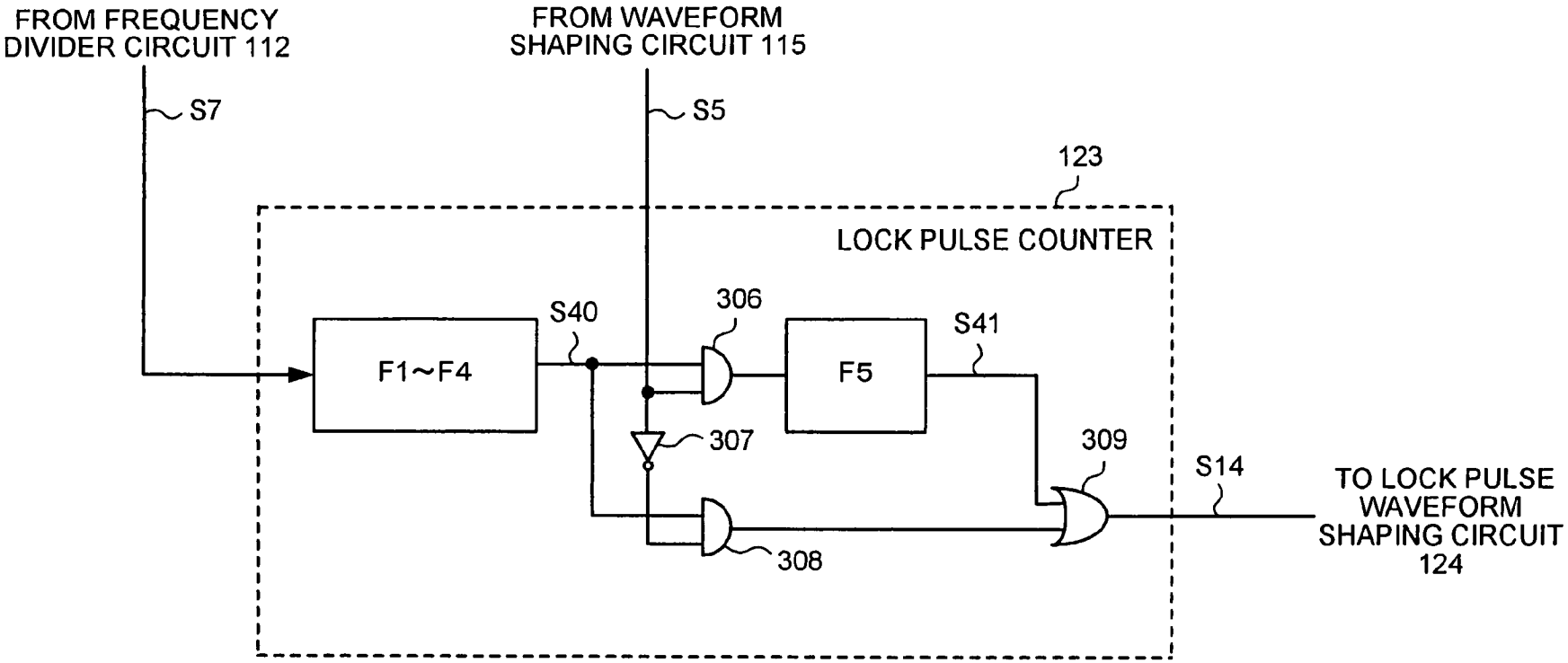
FIG. 3 is a circuit diagram showing a configuration of a lock pulse counter.

FIG. 3 is a circuit diagram showing a configuration of the lock pulse counter. The lock pulse counter 123 secures an output term of a lock pulse such that the output term of the lock pulse does not become short during the logic frequency adjustment (DF adjustment) executed at a pre-determined period (for example, every ten seconds). The lock pulse counter 123 has an AND circuit 306 that is input with a frequency-dividing output S7 provided from the frequency divider circuit 112, and is input with four counters F1 to F4 for frequency-division connected in tandem, an output S40 of the final-stage counter F4, and the output S5 for every DF adjustment from the waveform shaping circuit 115; an inverter 307 that inverts the output S5 of the waveform shaping circuit 115; an AND circuit 308 that is input with the output S40 of the final-stage counter F4 and the output S5 of the waveform shaping circuit 115 that have been inverted by the inverter 307; and an OR circuit 309 that is input with a counter F5 for counting an output of the AND circuit 306, an output S41 of the counter F5, and an output of the AND circuit 308.

For the output S40 of the counters F1 to F4, the output S41 of the counter F5 outputs a long-term lock pulse. That is, the output S41 of the counter F5 is used when the DF adjustment is executed and the output S40 of the counters F1 to F4 is used when the DF adjustment is not executed, and, thereby, an output term of a lock pulse is prevented from being shortened when the DF adjustments are executed every pre-determined period. That is, the output S14 of the OR circuit 309 secures a specific term as an output term of the lock pulse. The lock pulse is provided to the step motor 105 after shaping of the waveform thereof through the lock pulse waveform shaping circuit 124.

Figure 4:
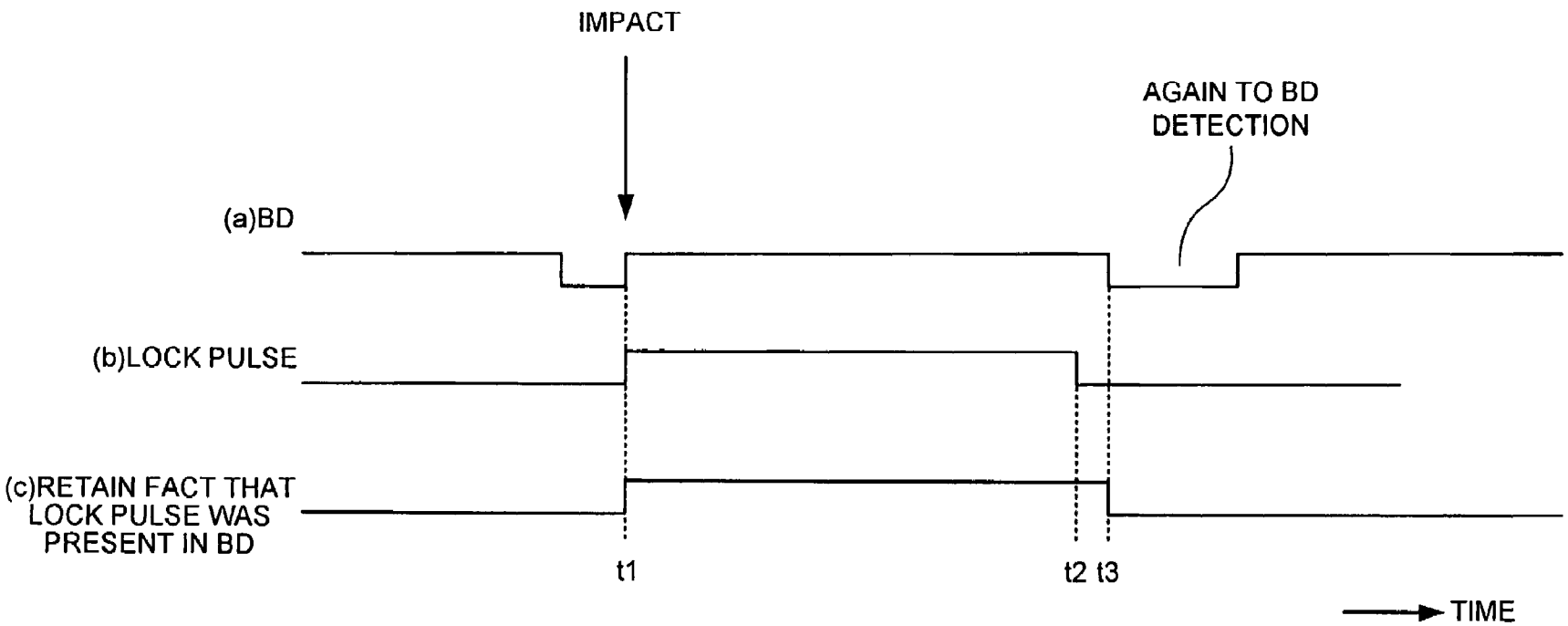
FIG. 4 is a timing chart showing a control of a BD controlling circuit.

FIG. 4 is a timing chart showing a control of the BD controlling circuit. The BD controlling circuit 117 periodically detects ((a) in FIG. 4) that the power source voltage has been lowered in the normal driving of hands, based on the timing of the frequency-diving outputs S4, S6 of the frequency divider circuits 112, 114. When a lock pulse ((b) in FIG. 4, and the signal S34 in FIG. 1) has been output from the lock pulse controlling circuit 122 due to detection of an impact (time t1), the BD controlling circuit 117 stops the detection of the power source voltage. As shown in (c) of FIG. 4, the BD controlling circuit 117 retains a condition for the term from the time t1 to a time t2 at which the output of the lock pulse is stopped, and resumes at a desired time (time t3) after the time t2 the detection of the power source voltage that has been stopped. The normal detection interval of the power source voltage is sufficiently longer than the timing described in (a) of FIG. 4.

Figure 5:
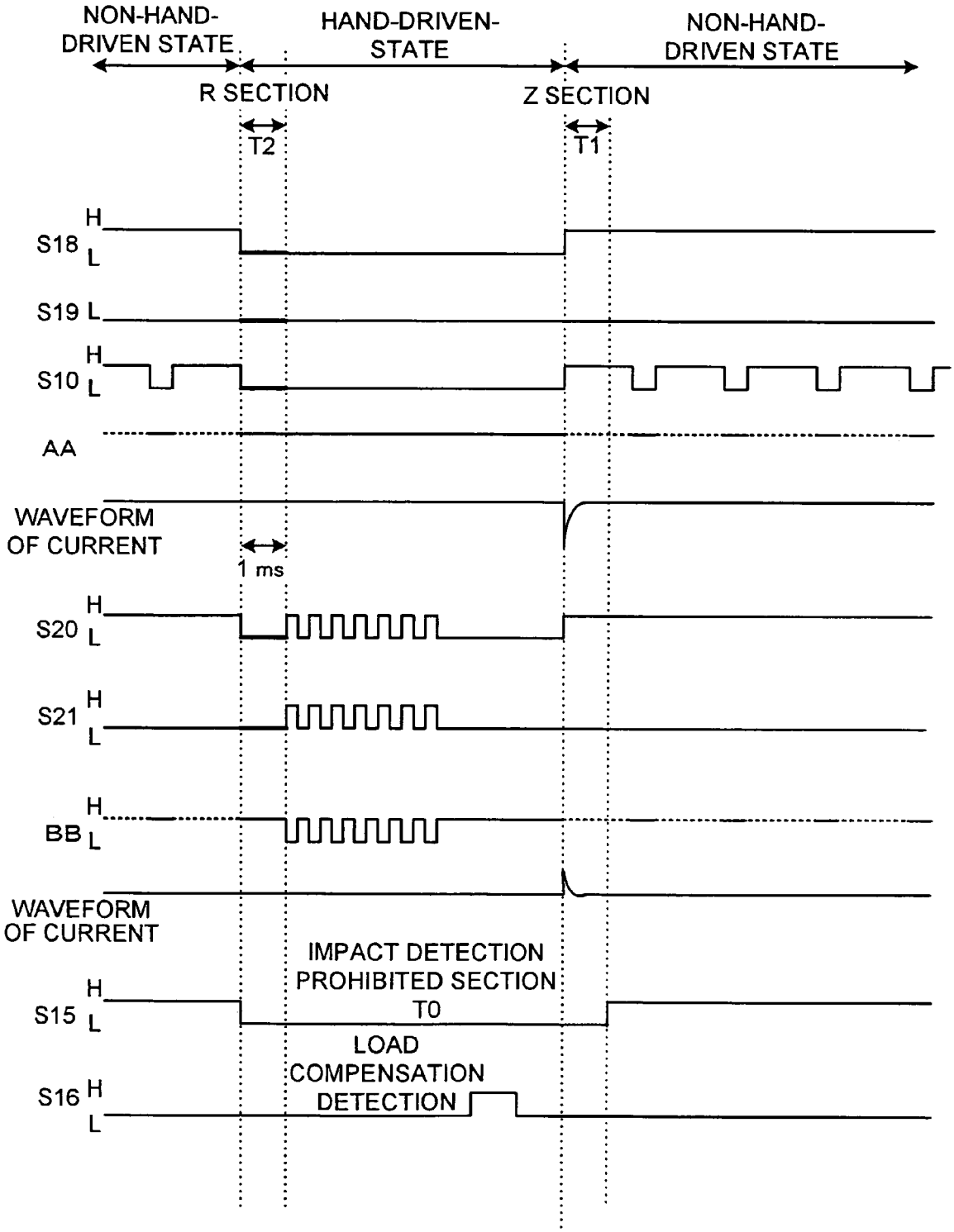
FIG. 5 is a timing chart showing a state of a signal at each unit respectively in a hand-driven state and a non-hand-driven state of a second hand.

The operation according to the above configuration will be described. FIG. 5 is a timing chart showing the state of a signal at each unit respectively in a hand-driven state and a non-hand-driven state of a second hand. As shown, the second hand has alternately non-hand-driven states and hand-driven states. When a non-hand-driven state is switched to a hand-driven state, for the controlling circuit 102, the output S18 to the transistor 131 is changed from [H] to [L] and the output S19 to the transistor 132 is not changed and remains at [L]. As shown, the output S10 of the chopper-amplification waveform shaping circuit 118 outputs periodic pulses for chopper-amplification in the non-hand-driven state. The signal lines AA, BB are activated to [H] for the terms depicted by solid lines in FIG. 5 and are OPEN for the terms depicted by dotted lines.

For the controlling circuit 102, the state of the output S20 to the transistor 133 is switched being triggered by the output of a driving pulse to a state where [H] and [L] alternate periodically, after a pre-determined time period (T2: for example, 1 ms) has passed since the state of the output S20 has become [H]. The state of the output S21 to the transistor 134 is also switched triggered by the driving pulse, from a [L] state to a state where [H] and [L] alternate periodically. The impact detecting resistor controlling circuit 126 prohibits impact detection using the output S15, throughout the hand-driven state (impact detection prohibited section T0). This impact detection prohibited section ends after a pre-determined term (T1) has passed since the hand-driven state has been switched to the non-hand-driven state. For the load compensation controlling circuit 125, the signal lines AA, BB are both open in a load compensation detecting section, and a current generated by a counter electromotive force is allowed. At the same time, the transistors 153, 154 are made ON and caused to have a potential of VDD, and a voltage generated by a counter electromotive force on one path is detected by the inverters 155, 156. Thus, whether the rotor 162 of the step motor 105 has been rotated is detected. Thus, after outputting a hand-driving pulse, the signal S16 is output for several milliseconds and detection of rotation is executed.

Figure 6:
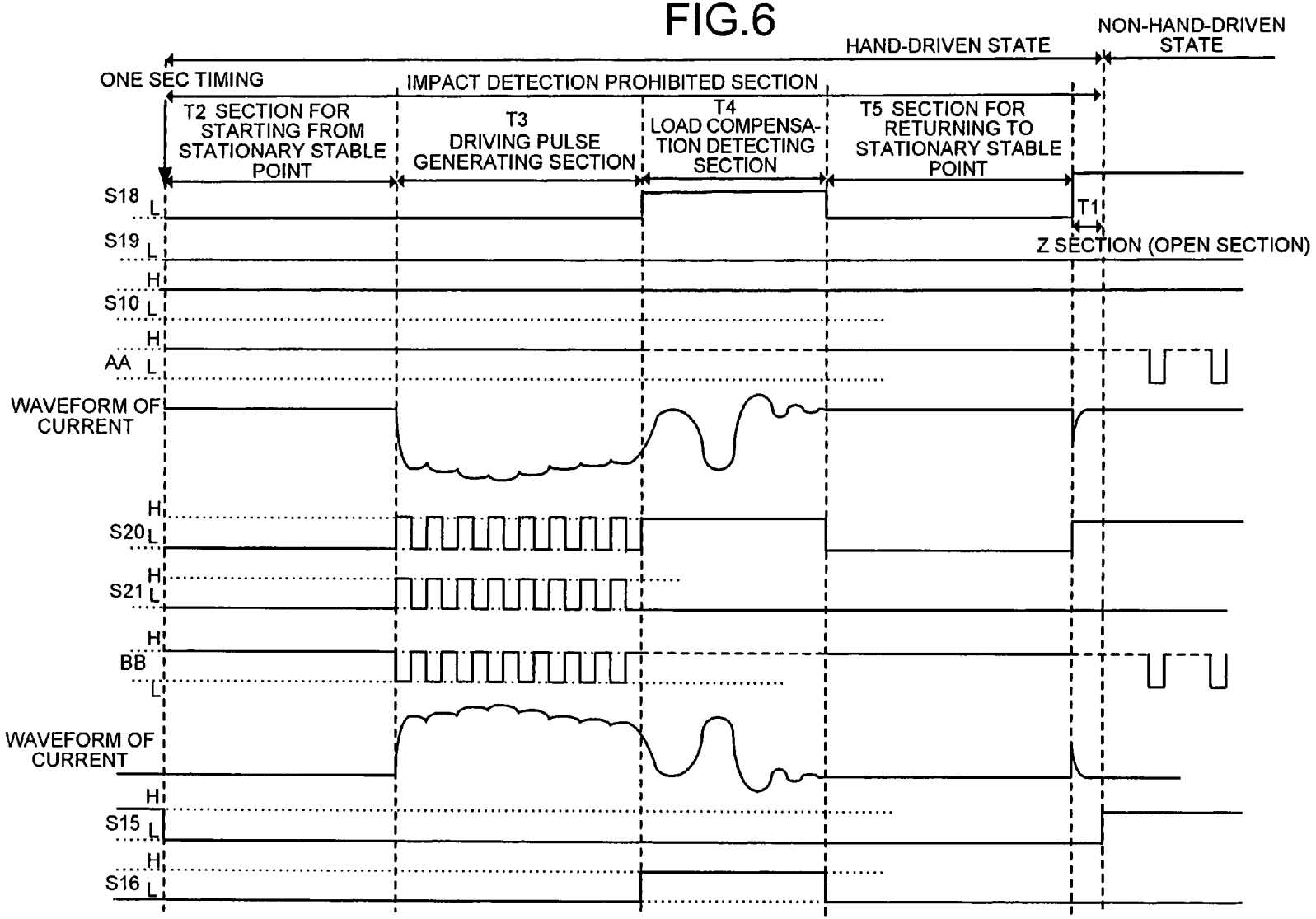
FIG. 6 is a timing chart showing a state of a signal at each unit in the hand-driven state.

FIG. 6 is a timing chart showing the state of a signal at each unit in the hand-driven state. The hand-driven state is constituted of, in the order from the start of the driving of hands, a section for starting from a stationary stable point (term T2: see also FIG. 5), a driving pulse generating section (term T3), a load compensation detecting section (term T4), and a section for returning to the stationary stable point (term T5). This stationary stable point is a rotational position for the rotor 162 of the step motor 105 to be stable in a state where the rotor 162 is being provided with no driving pulse.

The driving pulse is constituted of signals S20, S21 each having a pre-determined number of pulses for which the controlling circuit 102 orthogonally intersects the transistors 133, 134 as shown in FIG. 6. This driving pulse is output for a pre-determined time period (for example, 6 ms) after the section for starting from a stationary stable point (term T2) has passed. Because the signal lines AA, BB are open before outputting the driving pulse, the rotor 162 of the step motor 105 starts to rotate from an unstable position that is not the stationary stable point when the driving pulse is provided suddenly. By providing this term T2, the rotor 162 can be pulled back to the stable stationary point. By providing this driving pulse, the waveform of the current flowing in the step motor 105 is varied as shown in FIG. 6. After the driving pulse generating section (term T3) has ended, the waveforms of the current on the signal lines AA, BB are varied as shown in FIG. 6 to be converged. During the load compensation detecting section (term T4), the output S16 is output from the load compensation controlling circuit 125 to detect a counter electromotive force from the step motor 105. After this, the hand-driven state ends after waiting for the passage of the section for returning to the stationary stable point (term T5).

Figure 7:
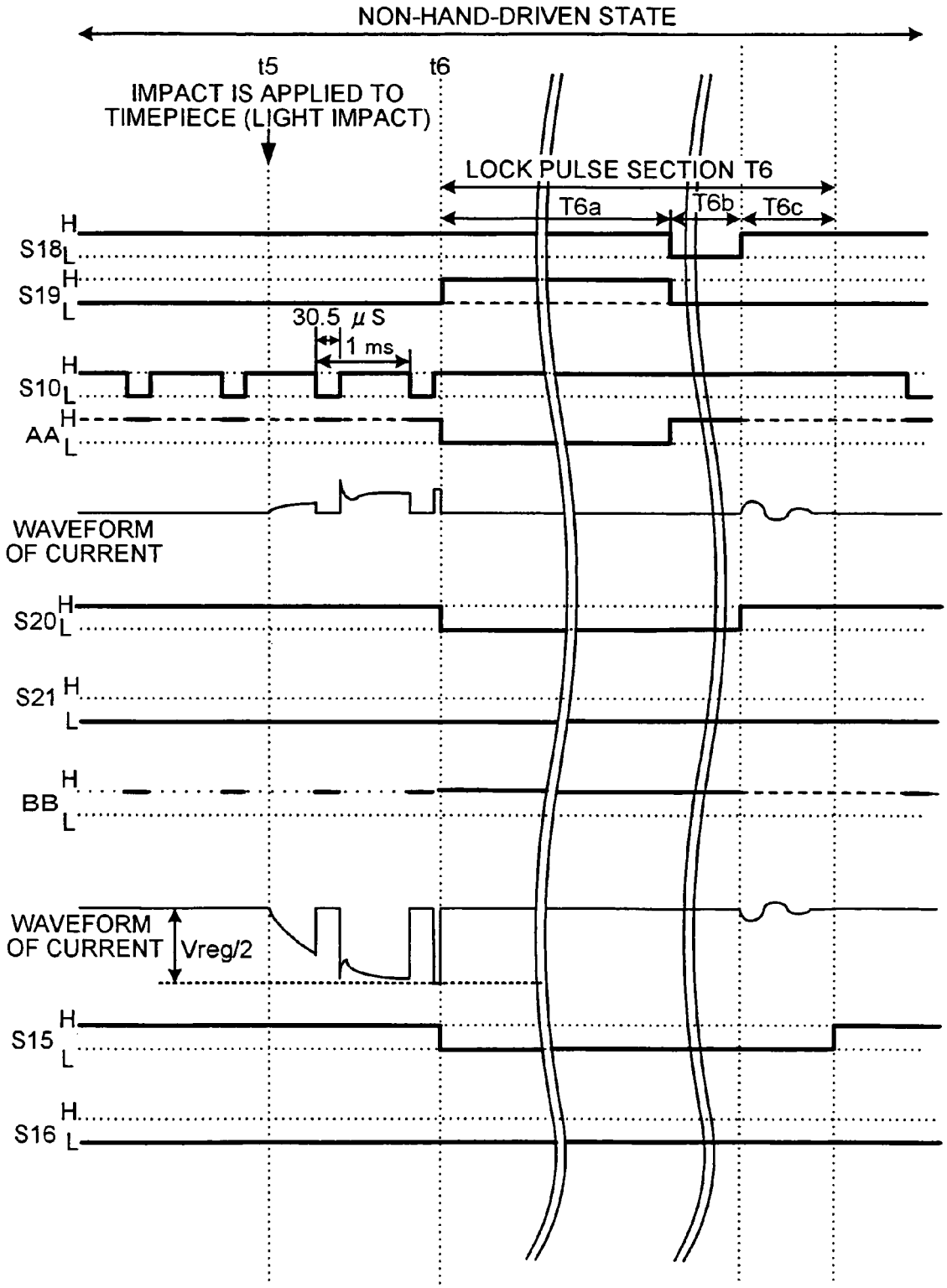
FIG. 7 is a timing chart showing a state of a signal at each unit when a light impact has occurred in the non-hand-driven state.

FIG. 7 is a timing chart showing the state of a signal at each unit when a light impact has occurred during the non-hand-driven state. When the state of the second hand is switched to the non-hand-driven state, the signal S18 is at [H], the signal S19 is at [L], the signal S10 is an alternating signal having the period of 1 ms and the chopper width of 30.5 μs that is the term for [L] state, the signal S20 is at [H], the signal S21 is at[L], the signal S15 is at [H], and the signal S16 is at [L].

It is assumed that a light impact is applied during the term t5 in this state. In this case, the waveform of the current is varied as shown in FIG. 7. The waveform of the current is amplified with the signal S10 that is the chopper-amplification. Thereby, as shown, even when the level of the waveform of the current generated due to the light impact is low, the level is chopper-amplified, and the peak value thereof is made high and exceeds the threshold value in a short time period from the occurrence of the light impact. Therefore, the impact can be detected. The details of the chopper-amplification will be described later.

The threshold value being set in the inverters 145, 146 of the impact detecting circuit 104 is a voltage that is a half of Vreg (Vreg/2) that has been defined as a constant voltage. When the induced electromotive force of the coil 161 of the step motor 105 exceeds this threshold value due to the application of the light impact (term t6), the impact detecting signal S33 is output to the lock pulse controlling circuit 122. The lock pulse controlling circuit 122 makes both of the signals S18, S19 at [H] that the circuit 122 provides to the transistors 131, 132 provided to the signal line AA, and outputs the lock pulse (the waveforms of the currents on the signal line BB is varied from [H] to [L]). At the same time, the lock pulse controlling circuit 122 varies both of the signals S20, S21 from at [H] to at [L] that the circuit 122 provides to the transistors 133, 134 provided to the signal line BB. The lock pulse controlling circuit 122 also makes the signal S15 at [L]. Though the waveform of the current on the signal line BB has exceeded the threshold value in the above description, a lock pulse is also output when the waveforms of the currents on the signal line AA has also exceeded the threshold value.

The deviation of the position of the second hand 106 is prevented by braking the second hand 106 with this lock pulse. This lock pulse brakes (stops and holds) the second hand 106 in the form of pulling back the rotation of the second hand 106 (rotor 162) by applying a pulse having the same phase as that of the driving pulse after detecting an impact. Thereby, control to correct the motion of the second hand 106 (rotor 162) is not necessary after this motion.

As shown in FIG. 7, the lock pulse section T6 is set to be, for example, 1 ms and supplies a continuous [L] level (lock term T6*a*) to the coil 161 of the step motor 105 through the signal line AA. Corresponding to the lock term T6*a* of the lock pulse section T6, the impact detecting resistor controlling circuit 126 maintains the waveform of the signal S15 at [L] and prohibits the detection of impacts. A stable section T6*b* is provided after the lock term T6*a* and, during this lock term T6*a*, the signals S18, S19 are supplied with the waveforms thereof switched to [L] to the transistors 131, 132 after the lock pulse has been supplied. An insensitive section T6*c* is provided after the stable section T6*b* and, during this section T6*c*, the waveform of the signal S18 is restored to [H]. Thus, as shown in FIG. 7, the fluctuation of the waveform of the current can be converged in the lock pulse section T6.

Figure 8:
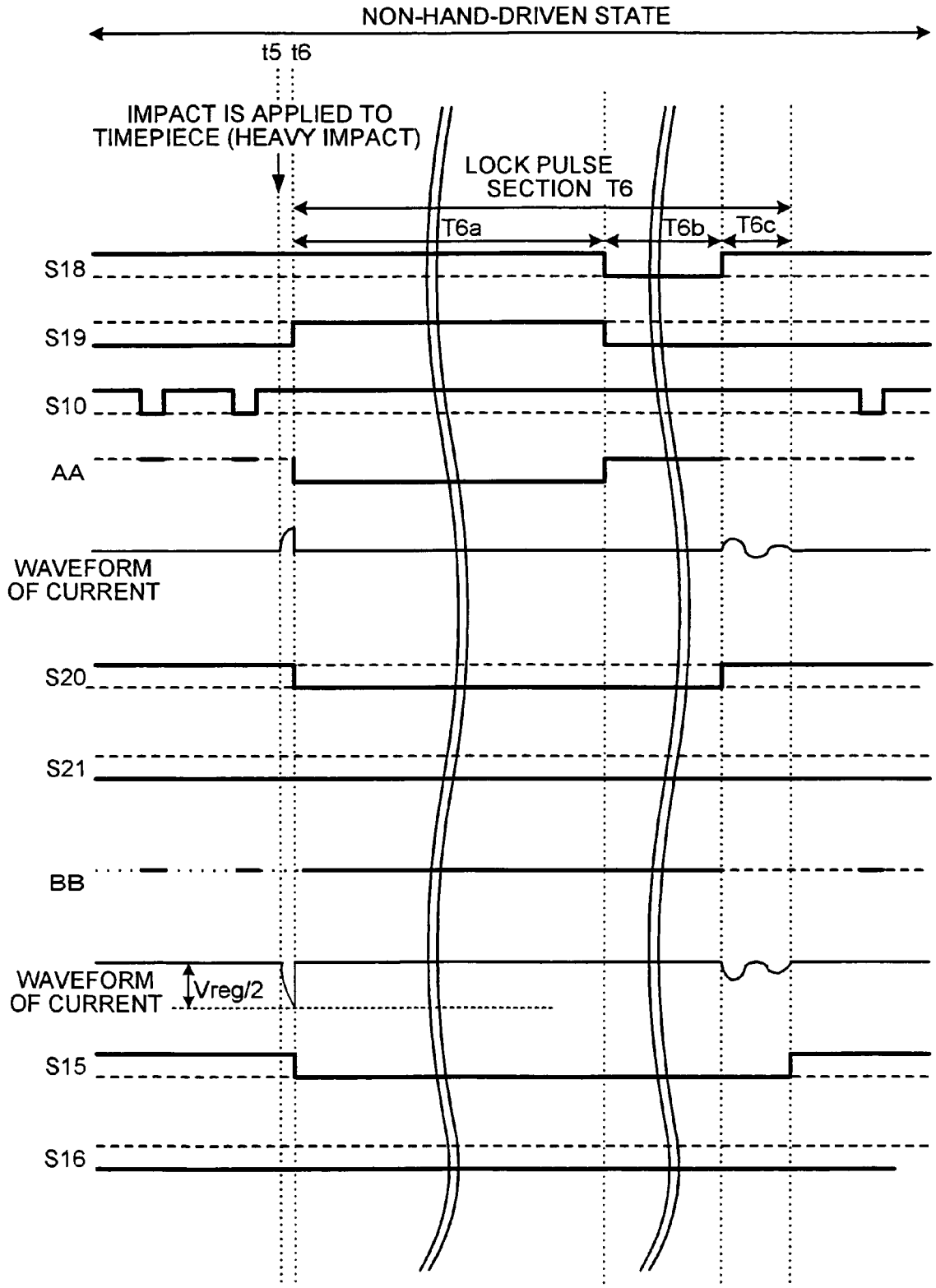
FIG. 8 is a timing chart showing a state of a signal at each unit when a heavy impact has occurred in the non-hand-driven state.

FIG. 8 is a timing chart showing the state of a signal at each unit when a heavy impact has occurred in a duration of the non-hand-driven state. Compared to FIG. 7, the state of the signals at each unit in FIG. 8 is approximately same. However, because this is a case of a heavy impact, the impact can be detected in a shorter time period than the light impact. When a heavy impact is applied during the time t5, the waveform of the current is varied such that the waveform exceeds the threshold value in a short time period as shown in FIG. 8. Thereby, when the current in the coil 161 of the step motor 105 has exceeded this threshold value (time t6) due to the application of the heavy impact, the lock pulse controlling circuit 122 switches the states of both of the signals S18, S19 to [H] and outputs a lock pulse. Each signal state after this is same as that of FIG. 17 and description for this is omitted.

Figure 9:
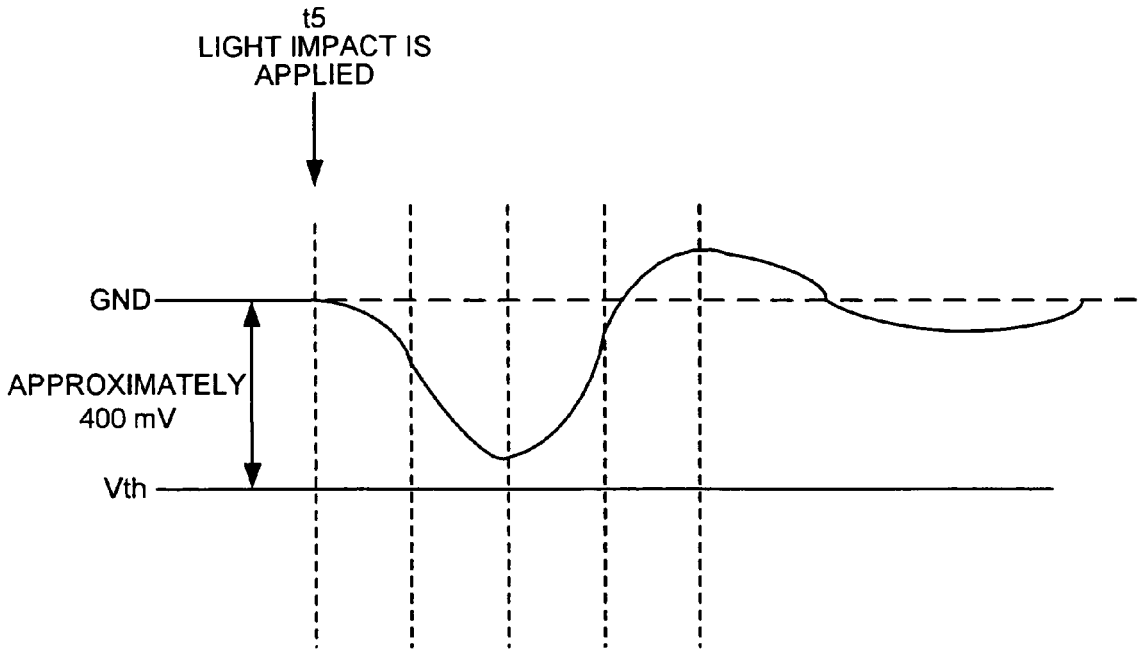
FIG. 9 is a waveform diagram of a current detected when a light impact is applied.

FIG. 9 is a waveform diagram of a current detected when a light impact is applied. When a light impact is applied at time t5, the waveform of the current in the coil 161 of the step motor 105 may not exceed a threshold value Vth for detecting an impact as shown in FIG. 9 because the level of the impact is low. Thereby, an impact may not be detected and a lock pulse can not be output when a light impact has been applied.

Figure 10:
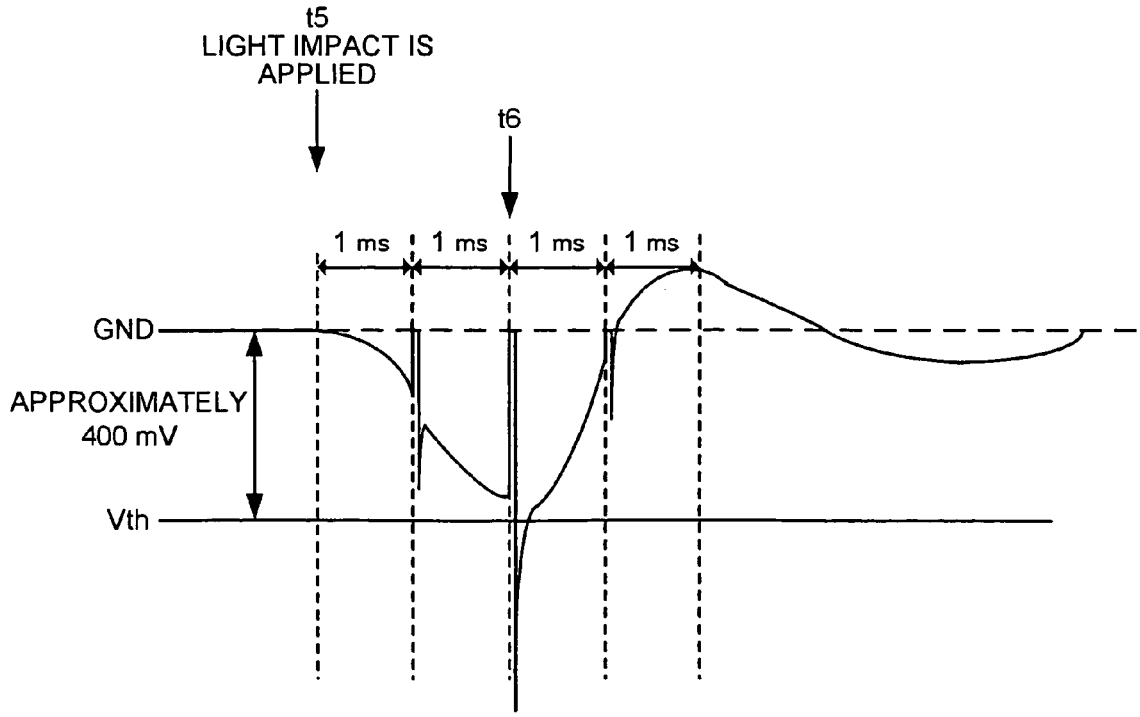
FIG. 10 is a waveform diagram of a current obtained by chopper amplification when a light impact is applied.

FIG. 10 is a waveform diagram of the current obtained by chopper-amplification when a light impact is applied. Similar to FIG. 9, a waveform of a current is shown that is obtained when a light impact is applied and is chopper-amplified by the chopper-amplification waveform shaping circuit 118. As shown, by chopper-amplifying at a pre-determined period (1 ms in the shown example), the value of the current generated when the light impact is applied exceeds the threshold value Vth set in the inverters 145, 146 for detecting impacts and the impact can be detected at time t6.

FIG. 11 is a chart showing an example of settings of the relation between the period and the chopper-width during the chopper-amplification. For chopper-amplification, the period and the [L]-term that is the chopper-width are respectively set at, for example, 1 ms (1 kHz) and 30.5 μs. Especially, the [L]-term that is the chopper-width is set at a reference period having the shortest period (fundamental frequency) that can be set for a timepiece. Problems have arisen that the detecting section becomes short if this term is larger than 30.5 μs and that chopper-amplification becomes impossible if this term is smaller than 30.5 μs. Why the period is set at 1 ms is to detect an impact before the peak voltage is exceeded by setting the period to be a term that is shorter than the interval (for example, 2 ms) of the counter electromotive force caused by the impact. Besides, the period is set at 1 ms because the interval created when the impact is applied may be shorter, and because the power consumption by the gate electrostatic capacities of the P-MOS transistors 135, 136 used as drivers are increased if this period is set to be shorter than 1 ms.

The amplification ratio of the chopper-amplification can be set or adjusted at an appropriate value for each type of timepiece (for example, the weight, the biased weight, and the size of the second hand 106) or for each individual timepiece. The period can be made variable corresponding to the power source voltage and, in this case, impacts can be stably detected coping with the variation of the power source voltage.

For the lock pulse, the pulse width can be varied by the power source voltage and the lock pulse can be output with the most efficient pulse width for the power source voltage. This lock pulse can brake the second hand 106 by making the lock pulse a pulse having a larger term than (for example, twice as large as) that of the driving pulse in the hand-driven state. To let the output of the lock pulse precede avoiding the detection timings of the above BD (battery power source voltage detection) and the DF adjustment (logic frequency adjustment), impacts can be detected preceding other processes when the deviation of the second hand 106 in the non-hand-driven state is prevented.

FIG. 12 and FIG. 13 are respectively explanatory charts for the relation between the power source voltage and the deviation of the displayed time in the configuration of the present invention. In these drawings, the resistance values of the impact detecting resistors 141, 143 are respectively 5 kΩ; the stable term T6*b* of the lock pulse is 5 ms; and the insensitive section T6*c* is 1 ms (see FIG. 7). FIG. 12 differs from FIG. 13 in that the lock term of the lock pulse of FIG. 12 is 5 ms and the lock term of the lock pulse of FIG. 13 is 10 ms. These charts respectively have the axis of abscissas representing the height of fall and the axis of ordinate representing the power source voltage (the voltage applied to the coil 161 of the step motor 106).

As shown in FIG. 12, when the lock term of the lock pulse is 5 ms, regardless of the height of fall, a deviation of time of a two-second delay of the displayed time is generated for most of the power source voltages equal or below 1.5 V to 1.25 V. Whereas, as shown in FIG. 13, when the lock term of the lock pulse is set at 10 ms, no deviation of the displayed time is generated for all the heights of falls even when the power source voltage is set at any power source voltage from 1.8 V to 1.25 V. In this manner, a deviation of the displayed time can be solved by setting the lock term of the lock pulse at an appropriate value.

When the power source voltage is relatively high (for example, 1.8 V to 1.6 V), a setting that shorten (for example, shorten from 10 ms to 5 ms) the lock term of the lock pulse is possible. Because of this, the controlling circuit 102 can be adapted to vary the lock term in response to a power source voltage of the battery detected by the BD controlling circuit 117, etc. For example, lock terms optimal for power source voltages may be set in advance in a storage unit, not shown, in the form of a table, etc., and a lock term corresponding to a detected power source voltage may be read from the storage unit and may be used.

As described above, according to the first embodiment of the present invention, whether the impact applied in the non-hand-driven state of the second hand is a light impact or a heavy impact, this impact can be detected and the deviation of the second hand can be prevented. Therefore, the correct time can be displayed. Because impacts can be detected with high precision, the second hand can be braked without increasing the retention torque of the step motor, and reduction of the power consumption necessary for the braking of the second hand, needed when an impact is detected can be facilitated.

Second Embodiment

Figure 14:
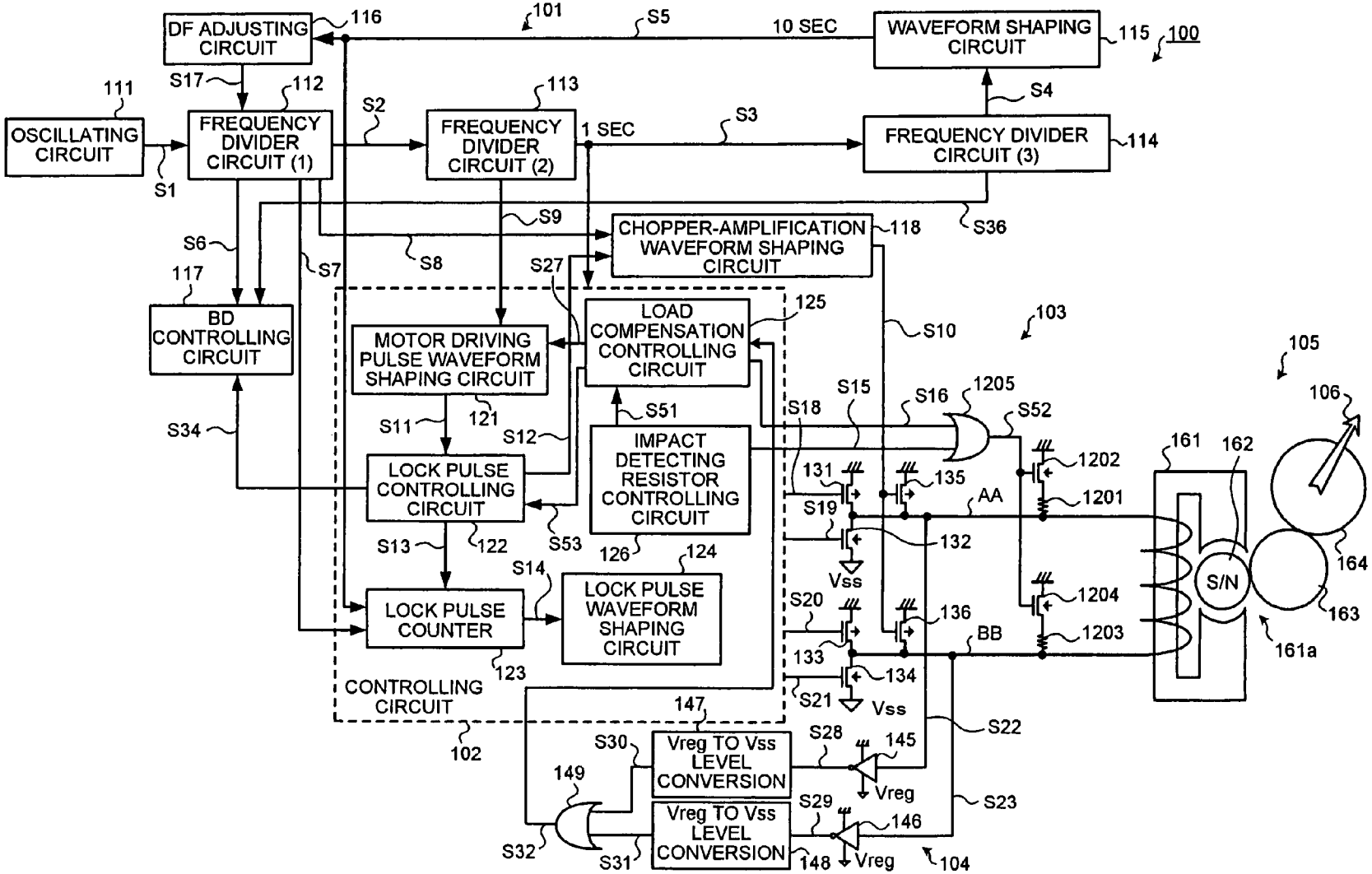
FIG. 14 is a block diagram of a configuration of an analog electronic timepiece according to a second embodiment of the present invention.

FIG. 14 is a block diagram showing the configuration of an analog electronic timepiece of a second embodiment of the present invention. Same reference symbols as those in the first embodiment are respectively given to the same components in the second embodiment that have the same configuration described using the first embodiment. In this second embodiment, the impact detecting resistor and the load compensation detecting resistor that are provided separately in the first embodiment are provided as one detecting resistor acting as those two resistors. The signal line AA is provided with a detecting resistor 1201 and a transistor 1202. The signal line BB is provided with a detecting resistor 1203 and a transistor 1204. Similarly to the first embodiment, the resistance values of the detecting resistors 1201, 1203 are set at the lowest value with which the fact that the rotor 162 of the step motor 105 has rotated due to an impact can be detected (for example, in a range of 40 kΩ to 160 kΩ). The detecting resistors 1201, 1203 may be adapted to be variable resistors and to be able to switch the resistance values thereof between a resistance value suitable for the time when an impact is detected (for example, 40 kΩ) and a resistance value suitable for the time when load compensation is detected (160 kΩ).

The signal S15 output by the impact detecting resistor controlling circuit 126 and the signal S16 output by the load compensation controlling circuit 125 are connected with the transistors 1202, 1204 through an OR circuit 1205 and are controlled respectively at the timing when an impact is detected and when load compensation is detected. The impact detecting signal S32 output by the impact detecting circuit 104 is output to the load compensation controlling circuit 125. A signal S51 output by the impact detecting resistor controlling circuit 126 is output for selecting whether the load compensation controlling circuit 125 is caused to act for load compensation as described above or to act as the lock pulse controlling circuit 122. The load compensation controlling circuit 125 acts as a load compensation controlling circuit in the hand-driven state and determines whether this circuit 125 outputs the signal S27; and acts as a lock pulse controlling circuit in the non-hand-driven state and determines whether this circuit 125 outputs a signal S53. In the configuration of the second embodiment, the signal state of each unit is same as that of the first embodiment and the second embodiment has a same impact detecting function.

According to the configuration of the second embodiment described above, similarly to the first embodiment, whether the impact applied in the non-hand-driven state of the second hand is a light impact or a heavy impact, this impact can be detected and the deviation of the second hand can be prevented. Therefore, correct time can be displayed. Because impacts can be detected with high precision, the second hand can be braked without increasing the retention torque of the step motor, and reduction of the power consumption necessary for the braking of the second hand, needed when an impact is detected can be facilitated. The number of resistors for the detection of impacts and detection of load compensation, and the number of transistors to be driven can be reduced, and reduction of the number of circuit elements, the costs, and the space can be facilitated.

As described above, according to the present invention, an impact can be detected in the non-hand-driven state of the second hand, a deviation of the second hand can be prevented, the time can be correctly displayed, and the second hand can be braked when an impact is detected regardless of the thickness, the size, the weight, the biased weight of the second hand. Therefore, the visibility of the displayed time can be improved by employing a larger second hand. Restrictions on the design of the second hand can be alleviated and incorporation of various designs can be facilitated.

The controlling method for the time when an impact is detected described in this embodiment is realized by a random logic. However, the method can also be realized by executing a program prepared in advance on a computer constituting the controlling circuit. This program is recorded in a computer-readable recording medium such as a hard disk, a flexible disk, a CD-ROM, an MO, a DVD, etc., and is executed by being read from the recording medium by the computer. This program may be a transmission medium distributable through a network such as the Internet, etc.

INDUSTRIAL APPLICABILITY

As described above, the analog electronic timepiece of the present invention is useful as an analog electronic timepiece having time hands capable of preventing a deviation of the time even when an impact is applied, and is particularly suitable for a wrist timepiece, etc., that is likely to receive impacts applied due to falling or colliding with objects because the timepiece is used being worn by a user.

The invention claimed is:

1. An analog electronic timepiece comprising:

a clock signal supplying unit configured to generate and supply a reference signal for clocking;

a step motor that drives hand motions of time hands;

a driving unit that has a signal line to drive the step motor;

an amplifying unit configured to amplify a counter electromotive force generated by the step motor;

an impact detecting unit configured to detect an impact applied externally based on an output signal level of the amplifying unit; and a controlling unit configured to control to drive the step motor by providing an intermittent driving pulse to the driving unit based on the reference signal supplied from the clock signal supplying unit when the time hands are in a hand-driven state, and to control to brake the step motor when an impact is detected by the impact detecting unit while the time hands are in a non-hand-driven state, wherein the controlling unit is configured to control the signal line to be in an OPEN state when the time hands are in the non-hand-driven state, except when a pulse is output from the amplifying unit during which the controlling unit controls the signal line to be in a HIGH or a LOW state.

2. The analog electronic timepiece according to claim 1, wherein the controlling unit includes a lock pulse output unit configured to control the step motor when the impact is detected, and the lock pulse output unit outputs a lock pulse for a term corresponding to a power source voltage supplied to the step motor.

3. The analog electronic timepiece according to claim 2, wherein the lock pulse output unit is configured to output a continuous pulse having a same phase as that of the driving pulse generated when the impact is detected.

4. The analog electronic timepiece according to claim 2, wherein the lock pulse output by the lock pulse output unit includes at least a lock term for outputting a continuous pulse and a stable section for outputting an inversed pulse after the lock term has passed.

5. The analog electronic timepiece according to claim 2, wherein the lock pulse output unit is configured to secure an output term of the lock pulse when the lock pulse is input at a time of a logic frequency adjustment executed at predetermined intervals.

6. The analog electronic timepiece according to claim 2, further comprising a battery detection controlling unit configured to make the output of the lock pulse precede when the lock pulse is output from the lock pulse output unit at a time of detection of a power source voltage executed at predetermined intervals.

7. The analog electronic timepiece according to claim 1, wherein the controlling unit includes a load compensating unit configured to detect rotation of a rotor based on detection of a counter electromotive force from a pulse motor soon after the output of the driving pulse.

8. The analog electronic timepiece according to claim 7, wherein the impact detecting unit includes an impact detecting resistor configured to detect a counter electromotive force from the pulse motor at the time of the impact, and the load compensating unit includes a load compensating resistor configured to detect a counter electromotive force from the pulse motor soon after the driving pulse is output.

9. The analog electronic timepiece according to claim 8, wherein the impact detecting resistor has a resistance value set at the minimal resistance value with which the rotation of the pulse motor is detected.

10. The analog electronic timepiece according to claim 8, wherein setting of the impact detecting resistor is set for each type of timepiece.

11. The analog electronic timepiece according to claim 7, further comprising a detecting resistor used commonly for impact detecting and for load compensating, wherein the impact detecting unit uses the detecting resistor to detect a counter electromotive force from the pulse motor at the time of the impact, and the load compensating unit uses the detecting resistor to detect a counter electromotive force from the pulse motor soon after the driving pulse is output.

12. The analog electronic timepiece according to claim 11, further comprising an OR gate that connects the impact detecting unit and the load compensating unit to the detecting resistor used commonly for impact detecting and for load compensating.

13. The analog electronic timepiece according to claim 1, wherein the controlling unit is configured to provide stable terms respectively for starting a rotor of a pulse motor from a stationary stable point thereof before outputting the driving pulse, and for returning the rotor of the pulse motor to the stationary stable point thereof after outputting the driving pulse.

14. The analog electronic timepiece according to claim 1, wherein the impact detecting unit includes inverters that operate based on supply of a source power that is adapted to supply a constant voltage without depending on a power source voltage.

15. The analog electronic timepiece according to claim 1, wherein the impact detecting unit detects the impact based on an output signal level of the amplifying unit, and an amplification ratio of the amplifying unit is set to a value that corresponds to at least one of a weight and a moment of inertia of the time hands.

16. The analog electronic timepiece according to claim 1, wherein the signal line being in the OPEN state allows a current generated by the counter electromotive force to travel thereon.

17. An analog electronic timepiece comprising:

a clock signal supplying unit configured to generate and supply a reference signal for clocking;

a step motor that drives hand motions of time hands;

a driving unit that has a signal line to drive the step motor;

an amplifying unit configured to amplify a counter electromotive force generated by the step motor;

an impact detecting unit configured to detect an impact applied externally based on an output signal level of the amplifying unit; and a controlling unit configured to control to drive the step motor by providing an intermittent driving pulse to the driving unit based on the reference signal supplied from the clock signal supplying unit when the time hands are in a hand-driven state, and to control to brake the step motor when an impact is detected by the impact detecting unit while the time hands are in a non-hand-driven state, wherein the controlling unit is configured to control the signal line to be in an OPEN state when the time hands are in the non-hand-driven state, except when a pulse is output from the amplifying unit during which the controlling unit controls the signal line to be in a HIGH or a LOW state, wherein the impact detecting unit detects the impact based on an output signal level of the amplifying unit, wherein an amplification ratio of the amplifying unit is set to a value that corresponds to at least one of a weight and a moment of inertia of the time hands, and wherein the amplifying unit is a chopper-amplifying unit configured to amplify at the amplification ratio based on a predetermined pulse period, and the predetermined pulse period is set to a value that corresponds to at least one of the weight and the moment of inertia of the time hands.

18. The analog electronic timepiece according to claim 17, wherein the predetermined pulse period of the chopper-amplifying unit is set further to a value that corresponds to a power source voltage.

19. The analog electronic timepiece according to claim 17, wherein in the chopper-amplifier unit, a chopper-width is set to 30.5 ms.

20. An analog electronic timepiece comprising:

a clock signal supplying unit configured to generate and supply a reference signal for clocking;

a step motor that drives hand motions of time hands;

a driving unit that has a signal line to drive the step motor;

an amplifying unit configured to amplify a counter electromotive force generated by the step motor;

an impact detecting unit configured to detect an impact applied externally based on an output signal level of the amplifying unit; and a controlling unit configured to control to drive the step motor by providing an intermittent driving pulse to the driving unit based on the reference signal supplied from the clock signal supplying unit when the time hands are in a hand-driven state, and to control to brake the step motor when an impact is detected by the impact detecting unit while the time hands are in a non-hand-driven state, wherein the controlling unit is configured to control the signal line to be in an OPEN state when the time hands are in the non-hand-driven state, except when a pulse is output from the amplifying unit during which the controlling unit controls the signal line to be in a HIGH or a LOW state, wherein the controlling unit includes a load compensating unit configured to detect rotation of a rotor based on detection of a counter electromotive force from a pulse motor soon after the output of the driving pulse, wherein the impact detecting unit includes an impact detecting resistor configured to detect a counter electromotive force from the pulse motor at the time of the impact, wherein the load compensating unit includes a load compensating resistor configured to detect a counter electromotive force from the pulse motor soon after the driving pulse is output, wherein the detecting resistor is a variable resistor, and wherein the resistance value of the detecting resistor switches between a first resistance value used for impact detection and a second resistance value used for load compensation.

* * * * *